US012084947B2

(12) United States Patent
Li et al.

(10) Patent No.: US 12,084,947 B2
(45) Date of Patent: Sep. 10, 2024

(54) SYSTEM AND METHOD FOR EXPLOITING MARINE NATURAL GAS HYDRATE RESOURCE

(71) Applicant: GUANGZHOU INSTITUTE OF ENERGY CONVERSION, CHINESE ACADEMY OF SCIENCES, Guangzhou (CN)

(72) Inventors: Xiaosen Li, Guangzhou (CN); Xuke Ruan, Guangzhou (CN); Zhaoyang Chen, Guangzhou (CN); Gang Li, Guangzhou (CN); Yu Zhang, Guangzhou (CN); Yi Wang, Guangzhou (CN); Kefeng Yan, Guangzhou (CN); Jiayuan Zhou, Guangzhou (CN)

(73) Assignee: GUANGZHOU INSTITUTE OF ENERGY CONVERSION, CHINESE ACADEMY OF SCIENCES, Guangzhou (CN)

( * ) Notice: Subject to any disclaimer, the term of this patent is extended or adjusted under 35 U.S.C. 154(b) by 0 days.

(21) Appl. No.: 18/016,683

(22) PCT Filed: Oct. 25, 2022

(86) PCT No.: PCT/CN2022/127373
§ 371 (c)(1),
(2) Date: Jan. 18, 2023

(87) PCT Pub. No.: WO2023/142553
PCT Pub. Date: Aug. 3, 2023

(65) Prior Publication Data

US 2024/0240541 A1 Jul. 18, 2024

(30) Foreign Application Priority Data

Sep. 26, 2022 (CN) ..... 202211176316.7

(51) Int. Cl.
*E21B 41/00* (2006.01)
*E21B 43/01* (2006.01)
*E21B 43/24* (2006.01)

(52) U.S. Cl.
CPC ..... *E21B 41/0099* (2020.05); *E21B 43/01* (2013.01); *E21B 43/24* (2013.01)

(58) Field of Classification Search
CPC ..... E21B 41/0099; E21B 43/01; E21B 43/24
See application file for complete search history.

(56) References Cited

U.S. PATENT DOCUMENTS

2003/0136585 A1* 7/2003 Matsuo ..... E21B 43/166 175/69
2007/0114026 A1* 5/2007 La Rovere ..... E21B 43/2401 166/57

* cited by examiner

*Primary Examiner* — Matthew R Buck
(74) *Attorney, Agent, or Firm* — Bayramoglu Law Offices LLC

(57) ABSTRACT

A system and method for exploiting a marine natural gas hydrate resource including a vertical well, comprising a sleeve configured to penetrate through a marine layer and a hydrate reservoir covering layer, and penetrate downwards into a natural gas hydrate reservoir; a section of the sleeve in the natural gas hydrate reservoir is provided with a perforating channel; a horizontal well, connected to a bottom end of the sleeve; a production string, disposed in the sleeve and extending downwards into the horizontal well, wherein a bottom of the production string is provided with a gas/water collection inlet; a hot water injection pipe, disposed in the production string; and a bottom of the hot water injection pipe is provided with a hot water injection opening; and a gas bladder, disposed in the horizontal well and connected to the hot water injection opening in the hot water injection pipe.

10 Claims, 1 Drawing Sheet

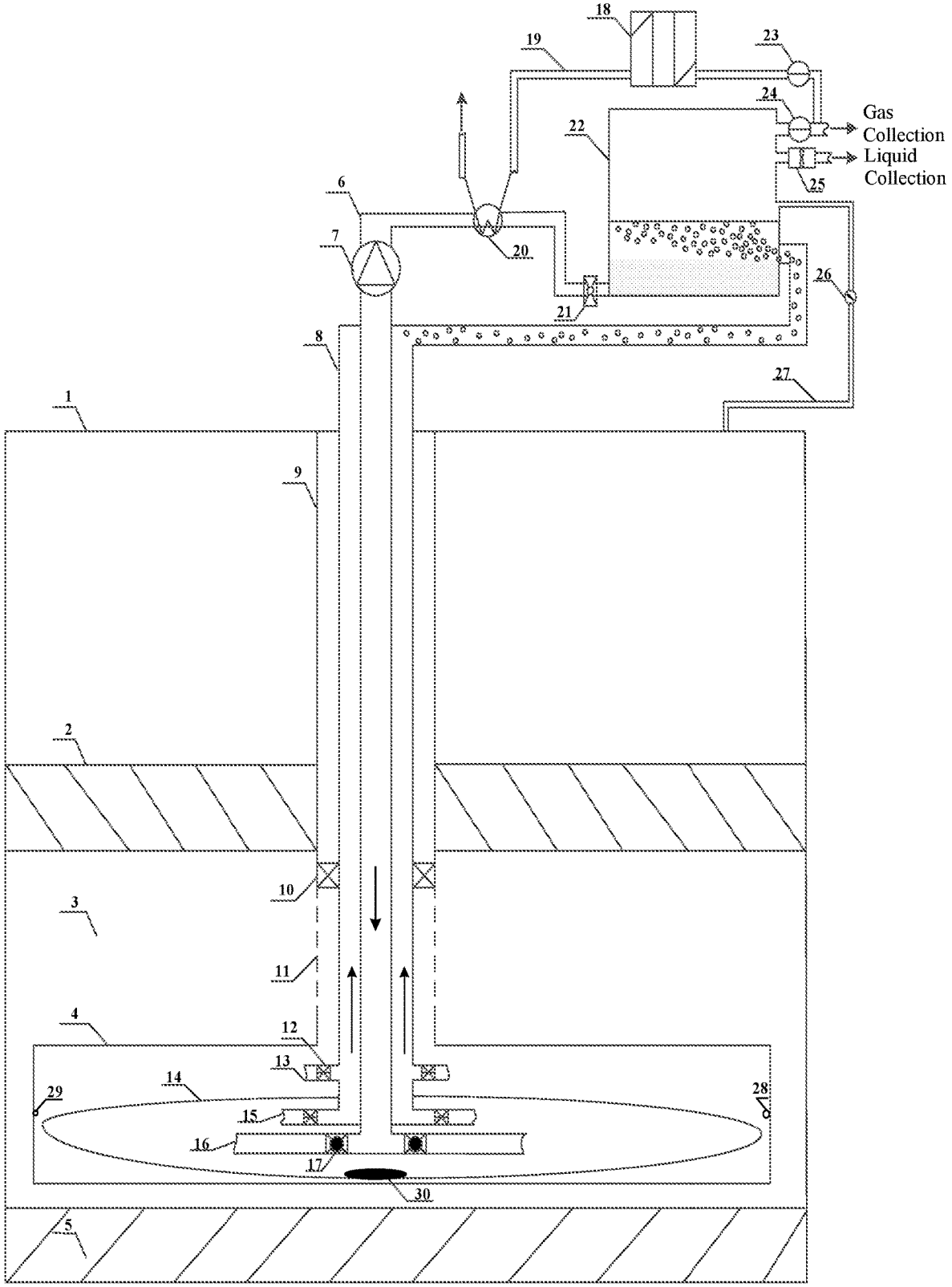
18
19
23
24
Gas
Collection
Liquid
Collection
22
25
6
7
20
26
21
8
27
1
9
2
10
3
11
4
12
13
14
29
28
15
16
17
30
5

SYSTEM AND METHOD FOR EXPLOITING MARINE NATURAL GAS HYDRATE RESOURCE

CROSS REFERENCES TO THE RELATED APPLICATIONS

This application is the national phase entry of International Application No. PCT/CN2022/127373, filed on Oct. 25, 2022, which is based upon and claims priority to Patent Applications No. CN 202211176316.7, filed on Sep. 26, 2022, the entire contents of which are incorporated herein by reference.

TECHNICAL FIELD

The present invention relates to the field of exploitation and utilization of marine natural gas hydrate resources, and specifically to a system for exploiting a marine natural gas hydrate resource via combination of depressurization and thermal stimulation.

BACKGROUND

According to statistics, the amount of proven natural gas hydrate resources in the world is twice the total amount of known conventional fossil fuels such as petroleum, coal, and natural gas [SLOAN E D, KOH C A. Clathrate hydrates of natural gases [M]. Boca Raton: CRC press, 2007]. Natural gas hydrates have been regarded as clean energy with the greatest potential to replace the conventional fossil fuels in the 21st century. Therefore, the resources have enormous potential. More than 90% of the hydrate resources are distributed on edges of oceans and continents.

Canada, the United States, Japan, and China have all conducted hydrate exploitation (pilot exploitation) in a hydrate-bearing reservoir with the methods such as heat injection, depressurization, and carbon dioxide replacement. Pilot exploitation conducted by Japan in the eastern Nankai Trough in 2013 and 2017 and pilot hydrate exploitation conducted by China in the Shenhu area of South China Sea in 2017 and 2020 are all implemented via depressurization. These times of field pilot exploitation comprehensively show that the method of depressurization is the most effective, and is especially easy to implement during offshore construction. Practice of the field pilot exploitation has revealed many problems with other exploitation methods, such as high exploitation costs, great energy loss, low efficiency, low production rate of medium- and long-term gas production, and difficulty in reservoir management during large-scale gas exploitation. For example, although heat injection-based exploitation can replenish reservoir energy and mitigate engineering geological risks to a large extent, because of factors such as serious heat loss, slow thermal energy transfer, and low thermal efficiency during heat injection to a reservoir, it is difficult to implement efficient generation of a natural gas hydrate by solely relying on heat injection during exploitation of a deep-sea natural gas hydrate, and a prospect of exploitation using heat injection as a main method is unoptimistic.

At present, based on research results of field pilot exploitation, numerical simulation, experimental tests, and the like, it is generally believed that a depressurization method and an improved solution based on the depressurization method may be the best way to implement industrial pilot exploitation of a marine natural gas hydrate, and that other methods can be used as auxiliary measures for increasing production and efficiency or stabilizing gas production.

SUMMARY

To resolve the exploitation problems described in the background, the present invention provides a system and method for exploiting a marine natural gas hydrate resource via the combination of depressurization and thermal stimulation, to achieve controllable costs, high energy utilization, safety, environmental protection, and an exploitation purpose of large-scale continuous gas production.

To achieve the above objective, the present invention adopts the following technical solution:

According to a first aspect, the present invention provides a system for exploiting a marine natural gas hydrate resource via combination of depressurization and thermal stimulation, including:

- A vertical well including a sleeve, wherein the sleeve is configured to penetrate through a marine layer and a hydrate reservoir covering layer, and penetrate downwards into a natural gas hydrate reservoir; and a section of the sleeve in the natural gas hydrate reservoir is provided with a perforating channel;
- A horizontal well connected to a bottom end of the sleeve;
- A production string disposed in the sleeve and extending downwards into the horizontal well, wherein a bottom of the production string is provided with a gas/water collection inlet;
- A hot water injection pipe disposed in the production string, wherein an annular region, in which operations of the depressurization through gas extraction and water pumping are performed, is formed between the production string and the hot water injection pipe; and a bottom of the hot water injection pipe is provided with a hot water injection opening; and
- A gas bladder disposed in the horizontal well and connected to the hot water injection opening in the hot water injection pipe.

Further, the system for exploiting a marine natural gas hydrate resource via combination of depressurization and thermal stimulation further includes:

- A gas/water collection and storage tank connected to the production string, and configured to store natural gas and water that are exploited from the natural gas hydrate reservoir, and to complete separation between and recycling of natural gas and seawater, wherein
- The gas/water collection and storage tank is disposed on an offshore platform; and one part of natural gas recycled by the gas/water collection and storage tank is collected, stored, and transported, and the other part of the natural gas is supplied to a gas power plant to meet the energy utilization demand of the offshore platform; and
- After being heated in a waste heat utilization apparatus using heat of waste fume of a gas power plant and being pressurized by a water injection pump, seawater recycled by the gas/water collection and storage tank is injected back into the gas bladder through the hot water injection pipe, thereby implementing thermal stimulation-based exploitation.

Further, the gas/water collection and storage tank is further connected to a seawater replenishment apparatus; when an amount of water, needing to be injected back into the gas bladder, in the gas/water collection and storage tank is less than a demand, seawater from the sea is pumped through a water pipeline of the seawater replenishment apparatus for replenishment; and when an amount of seawater pumped from the gas bladder back into the gas/water collection and storage tank is greater than a demand, water recycled by the gas/water collection and storage tank is connected through a liquid collection pipeline and processed for other purposes.

Further, a packer is disposed between the sleeve and the production string and above the perforating channel.

Further, the bottom of the production string is further provided with a water outlet; the water outlet is lower than the gas/water collection inlet; and the gas bladder is further connected to the water outlet.

Further, a one-way valve is disposed in each of the gas/water collection inlet and the water outlet.

Further, a constant pressure valve is disposed in the hot water injection opening.

Further, the gas bladder is provided with a drainage outlet.

Further, a temperature sensor and a pressure sensor are disposed in the horizontal well to monitor temperatures and pressures in the natural gas hydrate reservoir and the horizontal well in a real-time manner, so that recent changes and conditions of the natural gas hydrate reservoir and exploitation process can be learned, and an overall progress of exploitation via the combination of decompression and thermal stimulation can be regulated and controlled based on the recent conditions.

According to a second aspect, the present invention provides a method for exploiting a marine natural gas hydrate resource via combination of depressurization and thermal stimulation. The method is performed based on the above system and includes:

S1: using a drill bit to drill into the natural gas hydrate reservoir, then disposing the sleeve to penetrate through the marine layer and the hydrate reservoir covering layer and penetrate downwards into the natural gas hydrate reservoir, further drilling at a high-saturation natural gas hydrate layers ('sweet spot') location around a borehole of the vertical well, disposing a directionally distributed horizontal well, and completing well cementation and gravel-based sand control of the vertical well and horizontal well;

S2: when a volume of gas exploited via depressurization-induced hydrate dissociation in hydrate-bearing reservoir decreases, injecting hot water into the gas bladder disposed in the horizontal well through the hot water injection pipe disposed in the sleeve in a timely manner based on a volume of gas production from hydrate depressurization-induced dissociation around the sections of the vertical well and the horizontal well, as well as a pressure and a temperature of the natural gas hydrate reservoir; closing an inlet/outlet of the gas bladder after the hot water is injected; leaving the gas bladder to stand still and keeping the conditions for a period of time; and during this period of time, forming an enclosed space in the horizontal well by using a water injection-based expending and extending function of the gas bladder to fulfill a function of "soaking", so that contact and a heat transfer between hot water inside the gas bladder, and a fluid outside the gas bladder and a wall of the horizontal well can be increased to achieve an effective hydrate exploitation via thermal stimulation and meet a demand of heat for further depressurization-induced hydrate dissociation;

S3: after the hydrate in the natural gas hydrate reservoir is further decomposed, depressurizing seawater pumped from the gas bladder on the premise that stability of the natural gas hydrate reservoir and a wall of the horizontal well are ensured, determining the "soaking" time at the same time based on a volume of exploited gas as well as monitored data of a pressure and a temperature of the natural gas hydrate reservoir, and then draining seawater in the gas bladder to implement exploitation of a natural gas hydrate via the combination of depressurization and thermal stimulation;

S4: determining a flowing condition of a reservoir layer fluid in the natural gas hydrate reservoir and near the horizontal well based on the volume of exploited gas, and when it is detected that blockage occurs around a wellbore of the horizontal well, adjusting a speed and a flow rate of water being drained into the horizontal well by adjusting an open degree of a valve at the drainage outlet of the gas bladder, so that the pressure of the natural gas hydrate reservoir is kept stable during a water pumping-based depressurization process; and S5: repeating steps S2, S3, and S4, so that a purpose of exploiting a marine natural gas hydrate resource is achieved via continuous combined circulation of depressurization-based exploitation and thermal huff-and-puff hot water injection method.

Compared with the prior art, the present invention has the following beneficial effects:

1. A natural gas hydrate exploitation well structure including a large-size vertical well and the horizontal well according to the solution of the present invention expands a radius of natural gas hydrate exploitation and increases an area of natural gas hydrate dissociation.

2. A layout solution of the exploitation well structure provided in the present invention takes into account the distribution of hydrate in the hydrate-bearing sediments, and directional drilling of the horizontal well takes into account a high-saturation natural gas hydrate layers ('sweet spot') location around a borehole of the vertical well (a main borehole), so that the continuity of exploitation is ensured to the most extent, and the economic efficiency of exploitation is further ensured.

3. The solution provided in the present invention implements an effect of thermal stimulation-based (thermal huff and puff) exploitation by using the gas bladder in the horizontal well, implements plugging and heat transfer in any direction in the well by using the expansion and extension function of the gas bladder, and expands a diameter of a heat transfer area by several times based on an expansion and extension effect. Even in an exploitation process based on water pumping, gas extraction, and depressurization in the vertical well, the gas bladder can still ensure dynamic sealing of a section in the horizontal well, implement dynamically controllable "soaking" process, greatly enlarge the heat transfer area, and increase the heat transfer efficiency and heat energy input.

4. According to the solution provided in the present invention, a part of exploited gas/water is reutilized by an offshore platform, and hot water is heated and injected back by using waste heat of waste gas. Compared with a method using another heat source, the solution in the present invention makes full use of ready and convenient resources, thereby greatly reducing costs.

5. Instead of directly injecting hot water into a hydrate reservoir, the solution provided in the present invention is to inject hot water into the gas bladder in the horizontal well through the hot water injection pipe in the production string. The production string can perform a heat preservation function on the hot water injection pipe to reduce loss of total heat in a hot water injection process. In addition, during the injection process, hot water in the hot water injection pipe can also provide heat for a gas/water fluid pumped from the production string, thereby avoiding blockage of the wellbore caused by "hydrate reformation".

6. According to the solution provided in the present invention, "soaking" time is determined based on a volume of gas exploited during depressurization-based exploitation as well as monitored data related to a pressure, a temperature, and the like of the reservoir, and water in the gas bladder is drained in the timely manner to implement exploitation via the combination of depressurization and thermal stimulation. A speed and a flow rate of water being drained into the horizontal well and the natural gas hydrate reservoir can be adjusted by adjusting an open degree of a valve at a drainage outlet of the gas bladder, so that the pressure of the natural gas hydrate reservoir is kept stable during a water pumping-based depressurization process. Moreover, grit and the like near the wellbore can be flushed with the drained water to avoid blockage, which increases the peripheral permeability of an exploitation well, and facilitates effective and continuous decomposition and exploitation of a hydrate.

7. According to the technical method for exploiting a marine natural gas hydrate resource via combination of depressurization and thermal stimulation provided in the present invention, controllable exploitation costs, high energy utilization, safety, environmental protection, and a purpose of large-scale marine natural gas hydrate resource exploitation with continuous gas production are achieved by using an exploitation well structure including the large-scale vertical well, the horizontal well, and the gas bladder to perform continuous combined circulation of depressurization-based exploitation and thermal huff-and-puff method. Therefore, the method is a marine natural gas hydrate exploitation method with wide application and good market prospect, and can also provide reference and guidance for implementation of hydrate resource stimulation measures.

BRIEF DESCRIPTION OF THE DRAWINGS

FIG. 1 is a schematic composition diagram of a system for exploiting a marine natural gas hydrate resource via combination of depressurization and thermal stimulation according to an embodiment of the present invention.

In the drawings, the list of parts represented by reference numerals is as follows: 1: marine layer; 2: hydrate reservoir covering layer; 3: natural gas hydrate reservoir; 4: horizontal well; 5: underlying sediment layer; 6: hot water injection pipe; 7: water injection pump; 8: production string; 9: sleeve; 10: packer; 11: perforating channel; 12: one-way valve; 13: gas/water collection inlet; 14: gas bladder; 15: water outlet; 16: hot water injection opening; 17: constant pressure valve; 18: gas power plant; 19: flue gas pipeline; 20: waste heat utilization apparatus; 21: flow valve; 22: gas/water collection and storage tank; 23: second gas flowmeter; 24: first gas flowmeter; 25: fluid flowmeter; 26: seawater replenishment apparatus; 27: water pipeline; 28: temperature sensor; 29: pressure sensor; and 30: drainage outlet.

DETAILED DESCRIPTION OF THE EMBODIMENTS

Embodiments

In the description of the present invention, it should be noted that unless otherwise expressly specified and defined, terms such as "connected to" should be comprehended in a broad sense. For example, a connection may be a fixed connection, a detachable connection, or an integral connection; and may mean a direct connection, an indirect connection by means of an intermediary, or internal communication between two elements. For a person of ordinary skill in the art, specific meanings of the above terms in the present invention may be understood based on specific situations. The following further describes the technical solution of the present invention with reference to the accompanying drawings and embodiments.

For exploitation of marine natural gas hydrate resources, this application provides an exploitation well structure including a large-size vertical well and a horizontal well disposed in a natural gas hydrate accumulation area to implement the process of depressurization through water pumping, gas extraction. In this application, "large-size" refers to a maximum size range of a borehole acquired after well drilling and well completion that are performed with the most advanced drill bit of a maximum size. Specifically, an approximate value of "large-size" is determined based on conditions such as a wall thickness of a well that is drilled by using a drill bit of a maximum diameter and is completed based on conditions of a reservoir.

Specifically, as shown in FIG. 1, a system for exploiting a marine natural gas hydrate resource via combination of depressurization and thermal stimulation according to an embodiment of the present invention mainly includes a vertical well, the horizontal well 4, a production string 8, the hot water injection pipe 6, and a gas bladder 14. The vertical well mainly includes a sleeve 9. During application of this system, the sleeve 9 penetrates through a marine layer 1 and a hydrate reservoir covering layer 2, and penetrates downwards into a natural gas hydrate reservoir 3. A section of the sleeve 9 in the natural gas hydrate reservoir 3 is provided with a perforating channel 11.

The horizontal well 4 is communicated with a bottom end of the sleeve 9, forming an inverted T-shaped structure. The underlying sediment layer 5 is below the horizontal well 4.

The production string 8 is disposed in the sleeve 9, is coaxial with the sleeve 9, and extends downwards into the horizontal well 4. A bottom of the production string 8 is provided with a gas/water collection inlet 13.

The hot water injection pipe 6 is disposed in the production string 8 and is coaxial with the production string 8. An annular region, in which operations of the depressurization through gas extraction and water pumping are performed, is formed between the production string 8 and the hot water injection pipe 6, so that gas/water products generated during decomposition in the hydrate reservoir enter the sleeve 9 and the horizontal well 4 through the perforating channel 11, and are finally drained from the marine layer 1 through the gas/water collection inlet 13 in the bottom of the production string 8, and transported to an offshore platform.

The gas bladder 14 is disposed in the horizontal well 4 and is communicated with a hot water injection opening 16 in the bottom of the hot water injection pipe 6. During a hot water injection process, a size of the gas bladder 14 enlarges accordingly, so that the gas bladder 14 expands and extends continuously in the horizontal well 4, and hot water in the gas bladder 14 accordingly transfers heat outwards to provide heat required by thermal exploitation of a hydrate. In other words, instead of directly injecting hot water into the natural gas hydrate reservoir 3, this solution is to inject hot water into the gas bladder 14 in the horizontal well 4 through the hot water injection pipe 6 in the production string 8. The production string 8 can perform a heat preservation function on the hot water injection pipe 6 to reduce loss of total heat in a hot water injection process. In addition, during the injection process, hot water in the hot water injection pipe 6 can also provide heat for a gas/water fluid pumped from the production string 8, thereby avoiding blockage caused by "hydrate reformation".

Owing to the expansion and extension function of the gas bladder 14, an enclosed space is formed in the horizontal well 4, and plugging and heat transfer are implemented in any direction in the well, so that a "soaking" process similar to a thermal stimulation-based exploitation (thermal huff and puff) method is implemented, the heat transfer efficiency and energy utilization are increased, and the effect of thermal stimulation-based exploitation is achieved. Moreover, based on an expansion and extension effect, a diameter of a heat transfer area can be expanded by several times. Even in an exploitation process based on the depressurization through water pumping, gas extraction, the gas bladder 14 can still ensure dynamic sealing of a section in the horizontal well, implement dynamically controllable "soaking" process, greatly enlarge the heat transfer area, and increase the heat transfer efficiency and heat energy input. Specifically, the gas bladder 14 is made of a pressure-resistant and heat-conductive material, which can meet a requirement of thermal stimulation-based exploitation of an underground hydrate.

As an optimal embodiment of the system for exploiting a marine natural gas hydrate resource via combination of depressurization and thermal stimulation according to this embodiment, the system further includes a gas/water collection and storage tank 22 connected to the production string 8, and configured to store natural gas and water that are exploited from the natural gas hydrate reservoir, and to complete separation between and recycling of natural gas and seawater. Natural gas in the gas/water collection and storage tank 22 is output through a gas collection pipeline. A first gas flowmeter 24 is mounted in the gas collection pipeline. The gas/water collection and storage tank 22 is disposed on the offshore platform. One part of natural gas recycled by the gas/water collection and storage tank 22 is collected, stored, and transported, and the other part of the natural gas is supplied to a gas power plant 18 through a branch of the gas collection pipeline to meet an energy utilization demand of the offshore platform. In addition, according to an actual requirement of thermal stimulation-based cyclic exploitation (thermal huff and puff method) of an underground natural gas hydrate, seawater recycled by the gas/water collection and storage tank 22 is transported to a waste heat utilization apparatus 20 through a flow valve 21; heat of waste fume of the gas power plant 18 enters the waste heat utilization apparatus 20 through the flue gas pipeline 19; after being heated in the waste heat utilization apparatus 20 and being pressurized by a water injection pump 7, the seawater is injected back into the gas bladder 14 through the hot water injection pipe 6, thereby implementing thermal stimulation-based exploitation. A second gas flowmeter 23 is mounted on the branch of the gas collection pipeline.

In addition, the gas/water collection and storage tank 22 is further connected to a seawater replenishment apparatus 26; when an amount of water, needing to be injected back into the gas bladder 14, in the gas/water collection and storage tank 22 is less than a demand, seawater from the sea is pumped through a water pipeline 27 of the seawater replenishment apparatus 26 for replenishment; and when an amount of seawater pumped from the gas bladder 14 back into the gas/water collection and storage tank 22 is greater than a demand, water recycled by the gas/water collection and storage tank 22 is connected through a liquid collection pipeline and processed for other purposes. A fluid flowmeter 25 is mounted in the liquid collection pipeline.

As another optimal embodiment of the system for exploiting a marine natural gas hydrate resource via combination of depressurization and thermal stimulation according to this embodiment, a packer 10 is disposed between the sleeve 9 and the production string 8 and above the perforating channel 11. In other words, the packer 10 is disposed between the sleeve 9 and the production string 8 and on a lower edge of the hydrate reservoir covering layer 2 to prevent gas/water leakage from the sleeve 9 at this location.

As still another optimal embodiment of the system for exploiting a marine natural gas hydrate resource via combination of depressurization and thermal stimulation according to this embodiment, the bottom of the production string 8 is further provided with a water outlet 15; the water outlet 15 is lower than the gas/water collection inlet; and the gas bladder 14 is further communicated with the water outlet. Specifically, as shown in FIG. 1, both the water outlet 15 and the hot water injection opening 16 are encircled by the gas bladder 14. A one-way valve is disposed in each of the gas/water collection inlet 13 and the water outlet 15 to prevent gas/water backflow. A constant pressure valve 17 is disposed in the hot water injection opening 16, so that the gas bladder 14 can expand and extend outwards without being negatively affected during continuous water injection. During an entire later period of thermal stimulation-based (thermal huff and puff) exploitation, the water outlet 15 can be opened directly when seawater in the gas bladder 14 does not need to be used for other purposes, so that the seawater in the gas bladder 14 together with gas/water products from the natural gas hydrate reservoir is pumped back into the gas/water collection and storage tank 22 on the offshore platform by using pressure difference in the production string 8 generated during the depressurization process through gas extraction, water pumping. This is a first manner for draining seawater from the gas bladder 14. Moreover, the gas bladder 14 is further provided with a drainage outlet 30 configured to drain water into the horizontal well or the natural gas hydrate reservoir 3.

As yet another optimal embodiment of the system for exploiting a marine natural gas hydrate resource via combination of depressurization and thermal stimulation according to this embodiment, a temperature sensor 28 and a pressure sensor 29 are disposed in the horizontal well 4 to monitor temperature changes and pressure changes in the natural gas hydrate reservoir and the horizontal well in a real-time manner, so that recent changes and conditions of the natural gas hydrate reservoir and exploitation process can be learned, and an overall progress of exploitation via the combination of decompression and thermal stimulation can be regulated and controlled based on the recent conditions. In addition to natural gas hydrate exploitation based on the depressurization through gas extraction, water pumping being performed by using the annular region formed between the production string 8 and the hot water injection pipe 6, when a volume of gas exploited via depressurization-induced hydrate dissociation in hydrate-bearing reservoir decreases, hot water having a certain temperature and meeting a requirement is injected into the gas bladder 14 by using the high-pressure water injection pump 7 in a timely manner based on changes and conditions of an underground temperature and pressure.

After the hydrate in the reservoir is further decomposed, on the premise that stability of the natural gas hydrate reservoir and a well wall are ensured, the "soaking" time in a thermal stimulation-based (thermal huff and puff) exploitation process is determined based on a volume of exploited gas as well as monitored data related to a pressure, a temperature, and the like of the natural gas hydrate reservoir; the one-way valve 12 at the water outlet 15 is opened in a timely manner; and seawater in the gas bladder 14 is pumped out by using pressure difference in the production string 8 generated during gas extraction, water pumping, and depressurization, or a water outlet valve at the drainage outlet 30 of the gas bladder 14 is opened for water drainage, thereby implementing natural gas hydrate exploitation based on the combination of depressurization and thermal stimulation. This is a second manner for draining seawater from the gas bladder 14.

The above two different manners for draining seawater from the gas bladder 14 have the following main difference: The first manner is to directly pump and drain seawater from the gas bladder 14, but the second manner is to drain seawater into the well and the natural gas hydrate reservoir for utilization. Selection of either of the manners for draining seawater from the bladder depends on a gas production condition, a hydrostatic pressure in the natural gas hydrate reservoir, and permeability around the well wall. When it is determined, based on a volume of exploited gas, pressure stability of the reservoir, and a permeability change around a well wall of a section of an exploitation well during an exploitation process, that the second draining manner needs to be used, a speed and a flow rate of water being drained into the horizontal well 4 and the natural gas hydrate reservoir can be adjusted by adjusting an open degree of the water outlet valve at the drainage outlet 30 of the gas bladder 14, so that the pressure of the natural gas hydrate reservoir is kept stable during a water pumping-based depressurization process, and grit and the like near a wellbore of the horizontal well can be flushed with the drained water to avoid blockage, which increases the peripheral permeability of the exploitation well, a volume of gas exploited during hydrate exploitation, and the like.

Accordingly, this embodiment further provides a method for exploiting a marine natural gas hydrate resource via combination of depressurization and thermal stimulation. The method is performed based on the above system and includes the following steps:

S1: using a drill bit to drill into the natural gas hydrate reservoir, then disposing the sleeve to penetrate through the marine layer and the hydrate reservoir covering layer and penetrate downwards into the natural gas hydrate reservoir, further drilling at a high-saturation natural gas hydrate layers ('sweet spot') location around a borehole of a vertical well, disposing a directionally distributed horizontal well, and completing well cementation and gravel-based sand control of the vertical well and horizontal well;

S2: when a volume of gas exploited via depressurization-induced hydrate dissociation in hydrate-bearing reservoir decreases, injecting hot water into the gas bladder disposed in the horizontal well through the hot water injection pipe disposed in the sleeve in a timely manner based on a volume of gas exploited from depressurization sections of the vertical well and the horizontal well, as well as a pressure and a temperature of the reservoir; closing an inlet/outlet of the gas bladder after the hot water is injected; leaving the gas bladder to stand still and keeping the conditions for a period of time; and during this period of time, forming an enclosed space in the horizontal well by using a water injection-based expending and extending function of the gas bladder to fulfill a function similar to "soaking" process in thermal stimulation-based (thermal huff and puff) exploitation, so that contact and a heat transfer efficiency between hot water inside the gas bladder, and a fluid outside the gas bladder and a wall of the horizontal well can be increased to achieve an effective hydrate exploitation via thermal stimulation and meet a demand of heat for further depressurization-induced hydrate dissociation;

S3: after the hydrate in the reservoir is further decomposed, depressurizing seawater pumped from the gas bladder on the premise that stability of the natural gas hydrate reservoir and a wall of the horizontal well are ensured, determining the "soaking" time at the same time based on a volume of exploited gas as well as monitored data of a pressure and a temperature of the natural gas hydrate reservoir, and then draining seawater in the gas bladder to implement exploitation of a natural gas hydrate via the combination of depressurization and thermal stimulation;

S4: determining a flowing condition of a reservoir layer fluid in the natural gas hydrate reservoir and near the horizontal well based on the volume of exploited gas, and when it is detected that blockage occurs around the wellbore of the horizontal well, adjusting a speed and a flow rate of water being drained into the horizontal well by adjusting an open degree of a valve at the drainage outlet of the gas bladder, so that the pressure of the natural gas hydrate reservoir is kept stable during a water pumping-based depressurization process, and grit and the like near the wellbore can be flushed with the drained water to avoid blockage, which increases the peripheral permeability of an exploitation well; and S5: repeating steps S2, S3, and S4, so that controllable exploitation costs, high energy utilization, safety, environmental protection, and a purpose of large-scale marine natural gas hydrate resource exploitation with continuous gas production are achieved via continuous combined circulation of depressurization-based exploitation and thermal huff-and-puff method.

The above embodiments are merely used to illustrate the technical concept and characteristics of the present invention, are intended to make those of ordinary skill in the art understand the content of the present invention and implement the present invention based on the content, and should not limit the protection scope of the present invention. Any equivalent change or modification figured out based on the essence of the content of the present invention shall fall within the protection scope of the present invention.

What is claimed is:

1. A system for exploiting a marine natural gas hydrate resource via a combination of depressurization and thermal stimulation, comprising:

a vertical well comprising a sleeve, wherein the sleeve is configured to penetrate through a marine layer and a hydrate reservoir covering layer, and penetrate downwards into a natural gas hydrate reservoir; and a section of the sleeve in the natural gas hydrate reservoir is provided with a perforating channel;

a horizontal well connected to a bottom end of the sleeve;

a production string disposed in the sleeve and extending downwards into the horizontal well, wherein a bottom of the production string is provided with a gas/water collection inlet;

a hot water injection pipe disposed in the production string, wherein an annular region, in which operations of the depressurization through gas extraction and water pumping are performed, is formed between the production string and the hot water injection pipe; and a bottom of the hot water injection pipe is provided with a hot water injection opening; and a gas bladder disposed in the horizontal well and connected to the hot water injection opening in the hot water injection pipe, wherein the gas bladder is configured to expand in the horizontal well when hot water is received from the hot water injection opening in the hot water injection pipe.

2. The system for exploiting the marine natural gas hydrate resource via the combination of depressurization and thermal stimulation according to claim 1, further comprising:

a gas/water collection and storage tank connected to the production string, and configured to store natural gas and water that are exploited from the natural gas hydrate reservoir, and to complete separation between and recycling of natural gas and seawater, wherein the gas/water collection and storage tank are disposed on an offshore platform; and one part of natural gas recycled by the gas/water collection and storage tank is collected, stored, and transported, and the other part of the natural gas is supplied to a gas power plant to meet an energy utilization demand of the offshore platform; and after being heated in a waste heat utilization apparatus using heat of waste fume of a gas power plant and being pressurized by a water injection pump, seawater recycled by the gas/water collection and storage tank is injected back into the gas bladder through the hot water injection pipe, thereby implementing thermal stimulation-based exploitation.

3. The system for exploiting the marine natural gas hydrate resource via the combination of depressurization and thermal stimulation according to claim 2, wherein the gas/water collection and storage tank is further connected to a seawater replenishment apparatus; when an amount of water, needing to be injected back into the gas bladder, in the gas/water collection and storage tank is less than a demand, seawater from the sea is pumped through a water pipeline of the seawater replenishment apparatus for replenishment; and when an amount of seawater pumped from the gas bladder back into the gas/water collection and storage tank is greater than a demand, water recycled by the gas/water collection and storage tank is connected through a liquid collection pipeline and processed for other purposes.

4. The system for exploiting the marine natural gas hydrate resource via the combination of depressurization and thermal stimulation according to claim 1, wherein a packer is disposed between the sleeve and the production string and above the perforating channel.

5. The system for exploiting the marine natural gas hydrate resource via the combination of depressurization and thermal stimulation according to claim 1, wherein the bottom of the production string is further provided with a water outlet; the water outlet is lower than the gas/water collection inlet; and the gas bladder is further connected to the water outlet.

6. The system for exploiting the marine natural gas hydrate resource via the combination of depressurization and thermal stimulation according to claim 5, wherein a one-way valve is disposed in each of the gas/water collection inlet and the water outlet.

7. The system for exploiting the marine natural gas hydrate resource via the combination of depressurization and thermal stimulation according to claim 1, wherein a constant pressure valve is disposed in the hot water injection opening.

8. The system for exploiting the marine natural gas hydrate resource via the combination of depressurization and thermal stimulation according to claim 1, wherein the gas bladder is provided with a drainage outlet.

9. The system for exploiting the marine natural gas hydrate resource via the combination of depressurization and thermal stimulation according to claim 8, wherein a temperature sensor and a pressure sensor are disposed in the horizontal well to monitor temperatures and pressures in the natural gas hydrate reservoir and the horizontal well in a real-time manner, learn recent changes and conditions of the natural gas hydrate reservoir and exploitation process, and regulate and control an overall progress of exploitation via the combination of decompression and thermal stimulation based on the recent conditions.

10. A method for exploiting a marine natural gas hydrate resource via a combination of depressurization and thermal stimulation, wherein the method is performed by the system according to claim 9, and the method comprises:

S1: using a drill bit to drill into the natural gas hydrate reservoir, then disposing the sleeve to penetrate through a marine layer and the hydrate reservoir covering layer and penetrate downwards into the natural gas hydrate reservoir, further drilling at a high-saturation natural gas hydrate layers sweet spot location around a borehole of the vertical well, disposing a directionally distributed horizontal well, and completing well cementation and gravel-based sand control of the vertical well and horizontal well;

S2: when a volume of gas exploited via depressurization-induced hydrate dissociation in hydrate-bearing reservoir decreases, injecting hot water into the gas bladder disposed in the horizontal well through a hot water injection pipe disposed in the sleeve in a timely manner based on a volume of gas exploited from depressurization sections of the vertical well and the horizontal well, as well as a pressure and a temperature of the natural gas hydrate reservoir; closing an inlet/outlet of the gas bladder after the hot water is injected; leaving the gas bladder to stand still and keeping the conditions for a period of time; and during this period of time, forming an enclosed space in the horizontal well by using a water injection-based expending and extending function of the gas bladder to fulfill a function of soaking, increasing contact and a heat transfer efficiency between hot water inside the gas bladder, and a fluid outside the gas bladder and a wall of the horizontal well to achieve an effective hydrate exploitation via thermal stimulation and meet a demand of heat for further depressurization-induced hydrate dissociation;

S3: after the hydrate in the natural gas hydrate reservoir is further decomposed, depressurizing seawater pumped from the gas bladder on the premise that stability of the natural gas hydrate reservoir and a wall of the horizontal well are ensured, determining the soaking time at the same time based on a volume of exploited gas as well as monitored data of a pressure and a temperature of the natural gas hydrate reservoir, and then draining seawater in the gas bladder to implement exploitation of a natural gas hydrate via the combination of depressurization and thermal stimulation;

S4: determining a flowing condition of a reservoir layer fluid in the natural gas hydrate reservoir and near the horizontal well based on the volume of exploited gas, and when a blockage is detected that occurs around a wellbore of the horizontal well, adjusting a speed and a flow rate of water being drained into the horizontal well by adjusting an open degree of a valve at the drainage outlet of the gas bladder, keeping the pressure of the natural gas hydrate reservoir stable during a water pumping-based depressurization process; and S5: repeating steps S2, S3, and S4, achieving a purpose of exploiting a marine natural gas hydrate resource via continuous combined circulation of depressurization-based exploitation and thermal huff-and-puff method.

* * * * *